United States Patent [19]

Lack

[11] Patent Number: 4,573,109

[45] Date of Patent: Feb. 25, 1986

[54] BATTERY POWERED LAMP UNIT AND SUPPORTING CONTAINER

[75] Inventor: Andrew J. Lack, Preesall, England

[73] Assignee: Gladson Limited, Blackpool, England

[21] Appl. No.: 661,185

[22] Filed: Oct. 15, 1984

[30] Foreign Application Priority Data

Oct. 14, 1983 [GB] United Kingdom ..... 8327642

[51] Int. Cl.[4] ..... F21L 27/00; E01F 9/01

[52] U.S. Cl. ..... 362/194; 404/6

[58] Field of Search ..... 362/189, 190, 191, 194, 362/195, 152; 404/6, 9, 10

[56] References Cited

U.S. PATENT DOCUMENTS 3,917,231 11/1975 Fink ..... 404/6

3,920,981 11/1975 Bailey ..... 362/190

FOREIGN PATENT DOCUMENTS 2132151 1/1973 Fed. Rep. of Germany ..... 404/10

2708982 9/1978 Fed. Rep. of Germany ..... 404/9

2107446 4/1983 United Kingdom ..... 404/9

*Primary Examiner*—William A. Cuchlinski, Jr.

*Attorney, Agent, or Firm*—Woodard, Weikart, Emhardt & Naughton

[57] ABSTRACT

A battery powered lamp unit in the form of an electric lamp integral with a compartment to contain at least one electric battery to power the lamp, or electrical circuit whereby the lamp is powered by the battery, and a tubular supporting container having an open end into which the electric lamp is insertable for support thereby with the container surrounding the compartment and the lamp projecting beyond the open end. Engageable elements on the unit and interior of the tubular container are arranged such that the elements engage one with another some distance within the container from the open end when the unit is inserted so as to prevent removal of the unit. The interengaged elements can be unlocked by a key which can be inserted into the tubular container.

10 Claims, 9 Drawing Figures

BATTERY POWERED LAMP UNIT AND SUPPORTING CONTAINER

This invention concerns a battery powered lamp unit in combination with a supporting container.

Road traffic and road works barriers are known in which horizontal rails are suspended between upright pots which carry electric lamps powered by electric batteries, for example dry cell batteries. It is known to mount the lamps at the top of the posts, and the batteries may be inside the posts or external thereof. But in either case known arrangements provide the lamps in units are separate from the batteries or from containers housing the batteries. Furthermore experience has shown that the lamp units and batteries can be rather easily removed from the posts by thieves.

According to the invention there is provided a battery powered lamp unit in combination with a supporting container, the combination comprising an integral unit comprising an electric lamp integral with a compartment to contain at least one electric battery to power said lamp and electrical circuit means whereby said lamp can be powered by the battery, a tubular supporting container having an open end into which the integral unit is insertable for support thereby with the container surrounding the compartment and the lamp projecting beyond said open end, locking means comprising engageable elements on the unit and interior of the tubular container such that said elements engage one with another some distance within the container from said open end when the unit is inserted so as to prevent removal of the unit, and said locking means being arranged to be unlocked by means insertable into the tubular container to cause disengagement of aforesaid engaged elements one from another so that the unit can be removed.

Preferably the locking means automatically locks when the integral unit is inserted a sufficient distance into the container.

Preferably the key means is insertable into the tubular container through an aperture in the container wall. However to unlock said locking means the key means may be insertable through the said end of the container in which the unit is inserted.

The integral unit may comprise (A) a lamp including a bulb holder, an electric bulb in said holder, and a light transmissible lens or cover surrounding the bulb, (B) a compartment integral or united with the lamp and disposed therebelow and arranged to hold an electric battery or a plurality of batteries connected in series, and (C) an electrical circuit connected between the bulb holder and battery or batteries whereby the bulb can be powered.

Therefore the unit is insertable into the container battery compartment first. The unit may be arranged to sit on the end of the container when inserted as far as desired thereinto.

The battery or batteries may be one or more dry cell batteries which may have helical wire terminals as is known per se.

The locking means may comprise a resiliently biased latch which may be a resilient flange engageable with and disengageable from abutment means. The flange may be mounted on the inside of the container wall and the abutment means on the exterior of the battery compartment, or the flange may be on the compartment and the abutment means on the interior of the container.

The flange may be disposed at an angle transverse to the longitudinal axis of the container and unit so that as the unit is located within the container by a relative movement between the two, the abutment means and flange can one relatively to the other pass with a displacement of the flange by the abutments towards a more axial disposition until the abutment means leaves a free edge of the flange which then springs back to or towards its former attitude so that edge can engage the abutment means and prevent its pasing the flange if effort is made to pull the unit from the container.

The key means acts on the flange to move it from its abutment means obstructing position so the unit can be removed.

Guide passage means may be defined between the battery compartment and the tubular container to guide the inserted key means from the opening in the container wall to the flange to displace it from the abutment means.

The key means may be of flexible material, for example plastics, so it may be deformed after insertion through the aperture so as to move along a direction generally axially of the tubular container towards the locking means by force exerted transversely to the axis of the container on that part of the key means externally of the container.

The flange may be bifurcated so the free ends of the bifurcations engage respective abutments forming said abutment means. A rib aligned with the slot bifurcating the flange may extend along the guide passage means. The key means may have a grove extending from its leading end to fit over the rib. The leading end of the key means may have a wedge shape, for ease of cooperation with the flange when releasing it from the abutment.

If an unauthorised tool such a a piece of wire is inserted through the opening and along the guide passage means it can only be applied to one bifurcation of the flange leaving the other bifurcation still locking the unit in place. As it is difficult to apply two such unauthorised tools simultaneously each to a respective bifurcation to achieve unlocking, this means it is virtually impossible for any one but a dedicated thief with time to space to remove the unit from the tubular container if that person lacks the proper key. The presence of the rib in the guide passage means is particularly effective in serving to frustrate the efforts of thieves since to reach both bifurcations of the flange two unauthorised tools operated in unison are needed one on each side of the rid. This is because the rib prevents a single tool capable of acting on both bifurcations simultaneously from passing along the guide passage means if the leading end of that tool is not grooved to accommodate the rib.

For additional security the locking means may comprise a plurality of locking arrangements acting to engage within the tubular container and lock the unit thereto.

The tubular container can be any desired tube. It may for example be a tubular plastics upright to support horizontal rails of a road traffic or road works barrier, in which case the lamp projects from the top of the post as a warning lamp.

The unit may include an intermediate part between and integral with the lamp and battery compartment. This intermediate part may contain electrical circuits which may comprise control circuits causing the lamp to flash. In use, the intermediate part may be outside the tubular container. When that latter is a barrier upright, the unit, and more particularly an outer surface of the intermediate part, may have an exposed coating which is retro-reflective of light. Also the unit, and more particularly the intermediate part may have external means for supporting the barrier rails. That means may be one or more lugs each having a keyhole slot for engagement by means, for example a tether, attached to a said rail.

The invention will now be further described by way of example with reference to the accompanying drawings in which.

Figure 1:
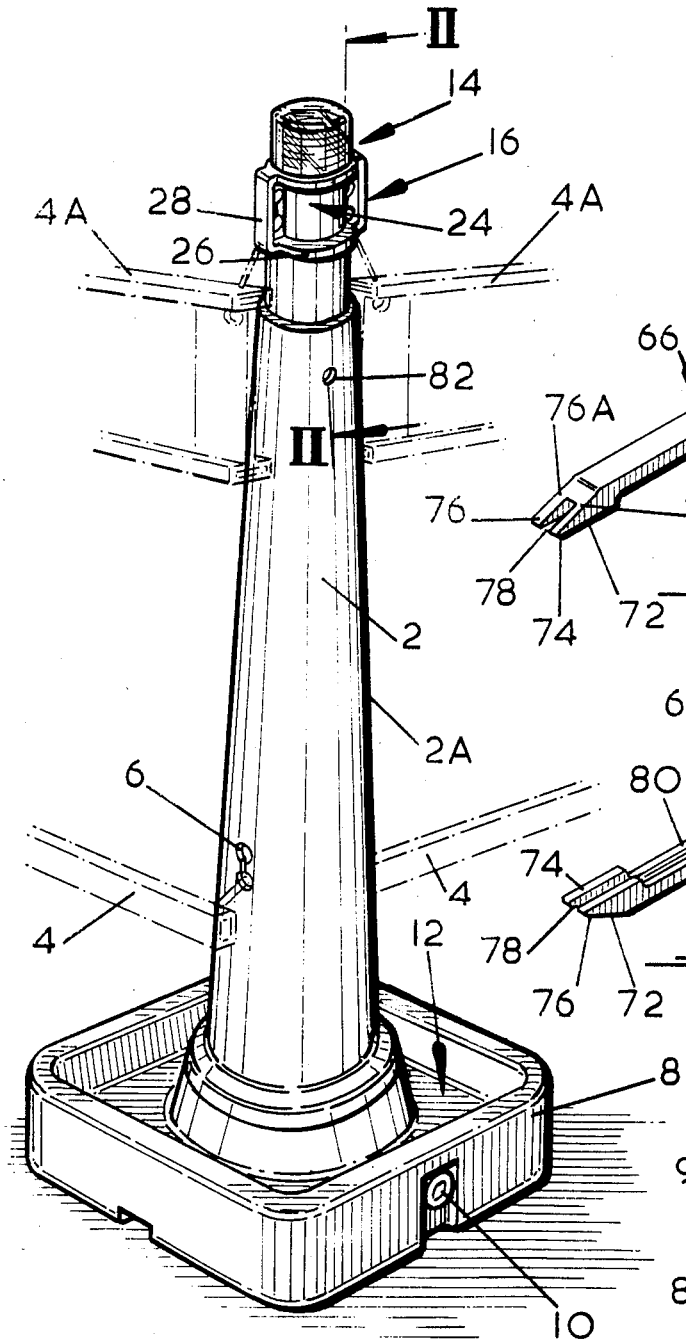
FIG. 1 is a perspective view of an upright or post formed according to the invention, that post being part of a road traffic or road works barrier.

Referring to FIG. 1 a tubular supporting container is in the form of an upright post 2 of a barrier to which horizontal rails 4 can be attached by a known tethering technique using headed tethers engaging keyhole slots (only one shown at 6) in a conical part 2A of the post which stands on a base 8. That base may be in the form of a container closable by a removable plug or cover 10 so that liquid ballast or particulate or friable solid ballast can be introduced into the container, and the base having a recessed tray-like upper part 12 to receive solid ballast material.

At its upper end the post has a cylindrical part 2B on top of which is a lamp 14 of an integral lamp and battery compartment unit 16.

Now with reference to the drawings as a whole, the lamp has a light transmissible lens or cover 18 giving illumination over 360° and containing an electric bulb 20 in a bulb holder 22 on an intermediate waisted portion 24 integral or in one piece with the lamp and having a lower surrounding collar 26 engaging on the top of the tube part 2B.

Intermediate part 24 has a pair of diametrically opposed lugs 28 formed with key-hole slots 6A engageable by headed tethering or attached means to support upper barrier rails 4A. Between the lugs, the outer surface of part 24 may be coated with material to retro-reflect light incident thereon, for example light from vehicle headlamps.

Formed integrally with the intermediate part 24 is a dry-cell battery holder 30 of square section having vertical walls 32, 34 and 36 on three sides, the fourth side being open for insertion of batteries B1 and B2 into respective upper and lowe compartments 38 and 40 divided from one another by a web 42 which is the base of compartment 38 and the ceiling of the compartment 40 having base web 44. The ceiling of compartment 38 is the base of the intermediate part 24. Both ceilings have electrical contacts respectively engaged by helical spring terminals T of the batteries. These contacts (not shown) are incorporated in an electrical circuit (not shown) with which the holder 30 and part 24 are provided to connect the batteries in series and to the lamp bulb. This circuit may include within part 24 a circuit arrangement to caue the bulb to flash, and the circuit may include on-off switch means (not shown) for example a push-button switch whereby the circuit may be made or interrupted. Access to the switch means to operate the latter may be gained for an operating tool through a hole (not shown) in post 2.

The integral unit 14, 24, 30 which may be substantially a one piece moulding of plastics with additional parts bonded thereto by adhesive, can be locked inside the post 2 by a lock arrangement 46.

The lock arrangement 46 comprises a resilient metal flange 48 being one leg of metal strip bent into an inverted V-shape having its other leg 50 secured to the inner surface of the tube part 2B. Flange 48 is transvere to the axial direction of the post 2 so its free lower end 48A stand further out into the post interior than the upper end of the flange where it joins the leg 50. Flange 48 is bifurcated along its length by a central slot 52.

The lock arrangement 46 further comprises a pair of spaced lugs 54 and 56 on the exterior of the holder 30, integral therewith and transverse to the axial direction of the holder. Each lug is engaged by a respective bifurcation of the flange 48 to hold the unit in the post.

Figure 2:
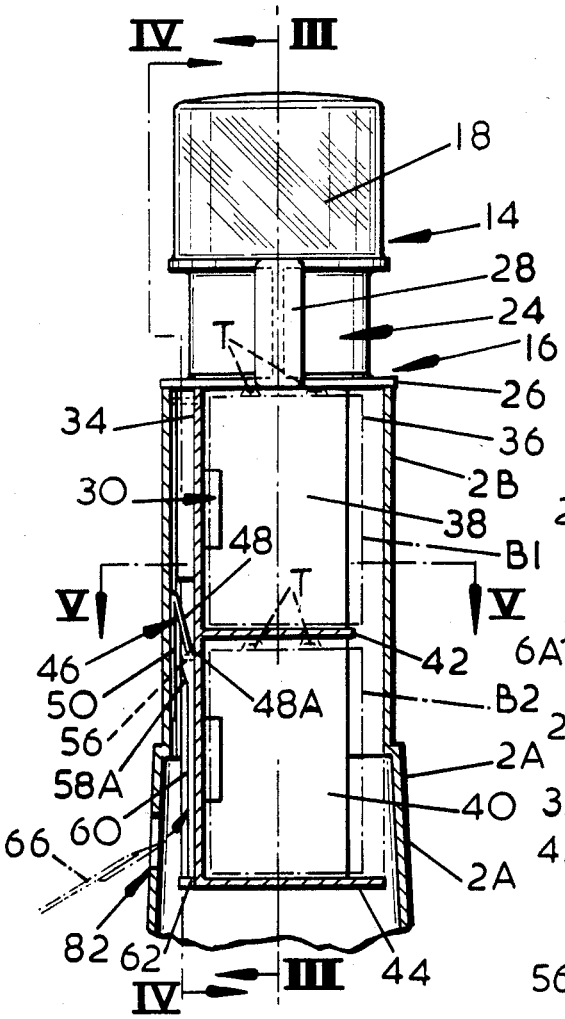
FIG. 2 is a view partly in section on line II—II and on enlarged scale of the upright in FIG. 1.
Figure 3:
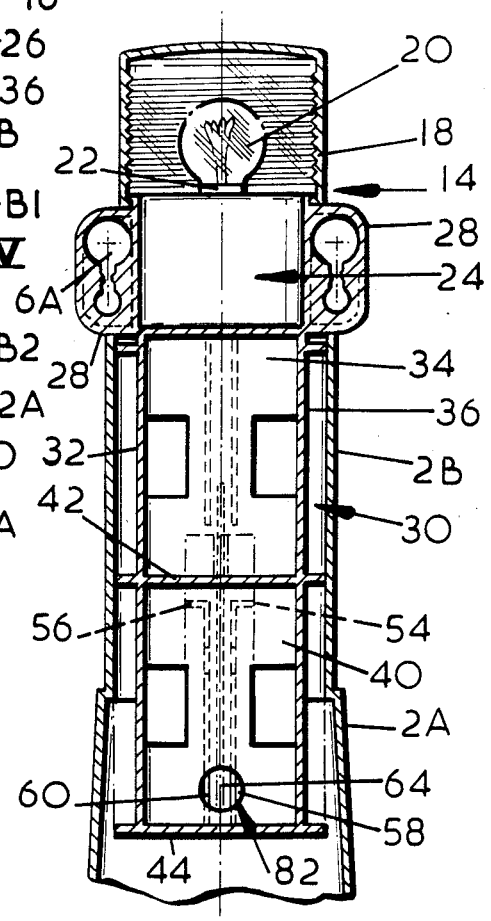
FIG. 3 is a partial section on line III—III in FIG. 2.
Figures 4, 4A, 4B:
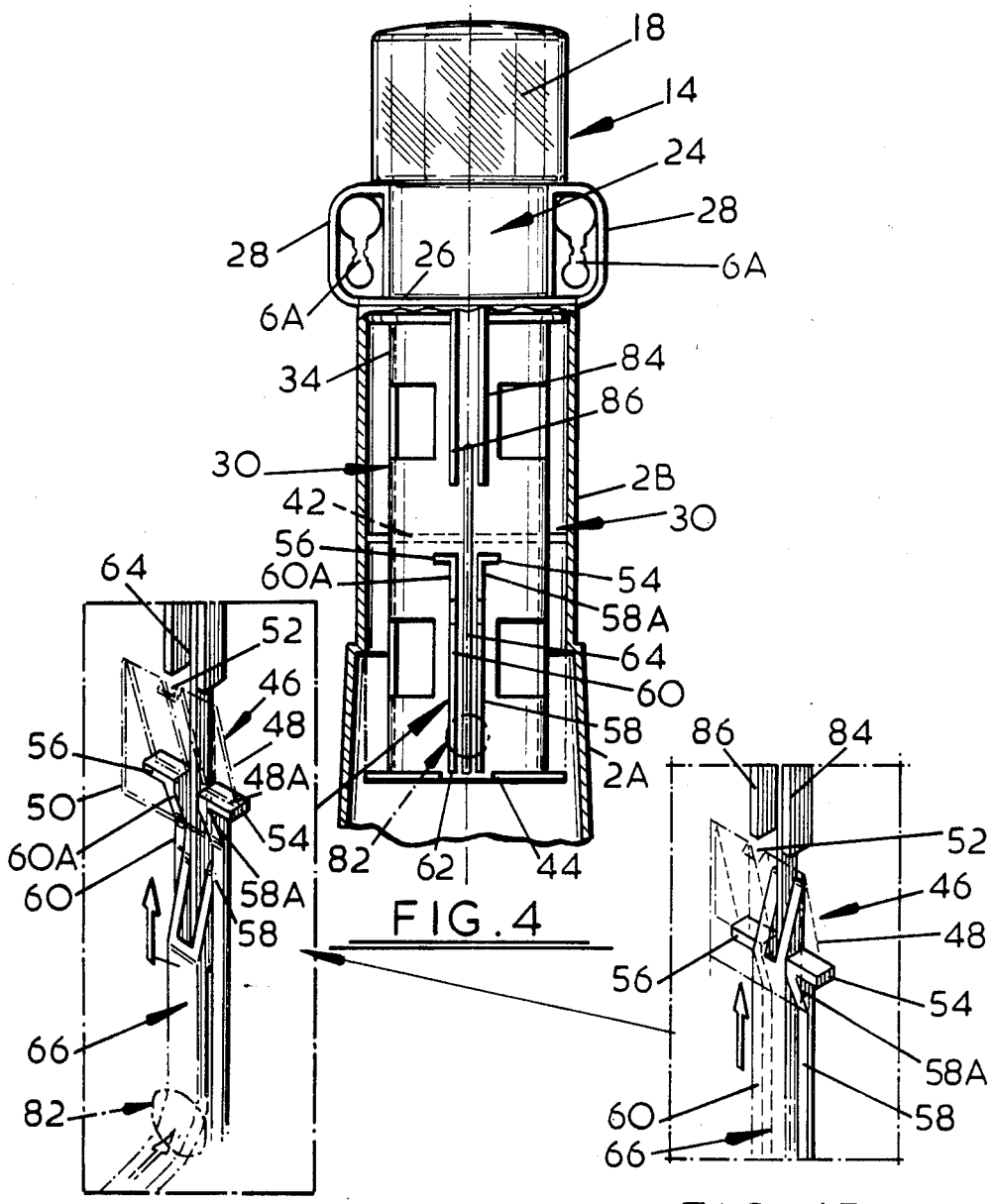
FIG. 4 is a fragmentary and somewhat diagrammatic sectional view on line IV—IV in FIG. 2, and FIGS. 4A and 4B are enlarged details for illutrating operation of the locking means.

Below the lugs 54 and 56 and joined thereto are parallel axially extending ribs 58 and 60 integral with the holder 30. The depth of each rib adjacent the lug is increased to that of the lug over a sloping or cam shaped portion 58A or 60A to press back the respective bifurcation of the flange 48 which springs back inwardly of the post to locate behind the lugs 54, 56 and engages them to lock the unit when it is fully inserted to the desired extent into the post 2. To ensure easier passage of the lower ends of the ribs 58, 60 past the flange 48 each lower end may be chamferred as at 62 (Fig. 2). An axially extending centre rid 64 between the ribs 58, 60 extends upwardly from adjacent the lower ends to those ribs to some distance above the lugs 54, 56. The rib 64 is also integral with the holder 30 and passes between the bifurcations of the flange 48.

Figure 6:
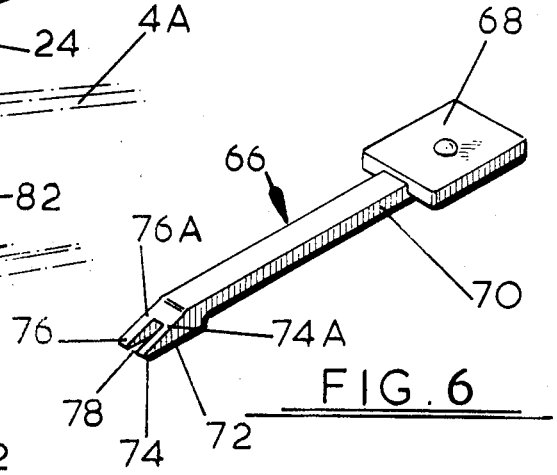
FIGS. 6 and 7 are perspective views respectively of upper and lower sides of key means used for releasing the locking means.
Figure 7:
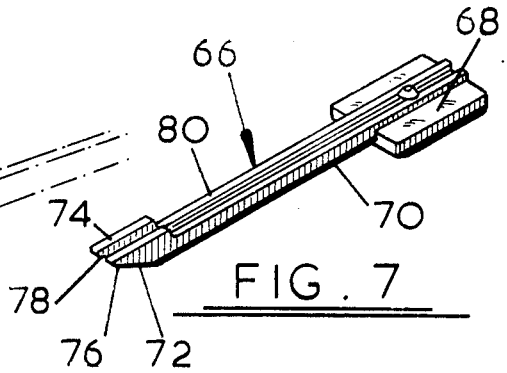

To release the lock arrangement 46 a key 66 shown in FIGS. 6 and 7 is used. This key of flexible plastics has a handle 68 at one end of a slender shank 70 having a wedge shaped head 72 at the other end. The head is bifurcated into two fingers 74 and 76 and the bifurcating slot 78 is extended along the underside of the head and shank by a groove 80.

When unit 16 (i.e. 14, 24, 30) is locked in place hole 82 through the post coincides substantially with the lower ends of two guide passages between ribs 58, 60, 64. The key head 74 is inserted into the hole 82 and so the head is between the ribs 58, 60, and the slot 78 and groove 80 accommodate the rib 64. The flexible shank 70 bends and allows the key head to be pushed upwardly, from outside the post, along the guide grooves, between the ribs 58, 60, 64 in the slight space between the holder wall 34 and the post until the sloping or cam faces 74A, 76A of the key head respectively press back a said bifurcation of the flange 48 at its free end 48A to release the lugs 54, 56 simultaneously so the unit 16 can be removed. Because the key head is moved in a slight space to its unlocking position it cannot jump out from between the ribs 58, 60.

Figure 5:
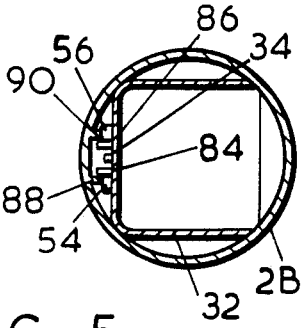
FIG. 5 is fragmentary section on line V—V in FIG. 2.

Aligned with the ribs 58 and 60 but spaced therefrom are upper axially extending ribs 84 and 86 integral with the holder 30. Ribs 84 and 86 are of greater depth than the flanges 54 and 56 and serve as guides interacting with parallel axially extending ribs 88 and 90 (FIG. 5) on the interior of the part 2 above the hole 82 ensure the unit 16 is guided accurately during insertion into the post 2 to bring the lugs 54, 56 into position to be locked by the flange 48. The lesser depth of the lugs 54, 56 enables them to avoid obstruction by the ribs 88, 90. In addition the ribs 88, 90 serve to abut the ribs 84, 86 to prevent rotation of the inserted unit 16 relative to the post 2.

What is claimed is:

1. A battery powered lamp unit in combination with a supporting container, the combination comprising an integral unit comprising an electric lamp integral with a compartment to contain at least one electric battery to power said lamp and electrical circuit means whereby said lamp can be powered by the battery, a tubular supporting container having an open end into which the integral unit is insertable for support thereby with the container surrounding the compartment and the lamp projecting beyond said open end, locking means comprising engageable elements on the unit and interior of the tubular container such that said elements engage one with another some distance within the container from said open end when the unit is inserted so as to prevent removal of the unit, and said locking means being arranged to be unlocked by key means insertable into the tubular container to cause disengagement of aforesaid engaged elements one from another so that the unit can be removed.

2. A battery powered lamp unit according to claim 1, wherein the locking means automatically locks when the integral unit is inserted a predetermined distance into the container.

3. A battery powered lamp unit according to claim 1, wherein the key means is insertable into the tubular container through an aperture in the container wall.

4. A battery powered lamp unit according to claim 1, wherein the key means is insertable through the said end of the container in which the unit is inserted.

5. A battery powered lamp unit according to claim 1, wherein the integral unit comprises a lamp including a bulb holder, an electric bulb in said holder, a light transmissible lens or cover surrounding the bulb, a compartment disposed below the lamp and arranged to hold an electric battery or batteries, and an electrical circuit connected between the bulb holder and battery or batteries whereby the bulb can be powered.

6. A battery powered lamp unit according to claim 1, wherein the locking means comprises a resiliently biased latch or flange engageable with and disengageable from abutment means.

7. A battery powered lamp unit according to claim 6, wherein the flange is bifurcated so the free ends of the bifurcations engage respective abutments forming said abutment means, a rib aligned with the slot bifurcating the flange extends along the guide passage means, and the key means has a groove extending from its leading end to fit over the rib, the leading edn of the key means having a wedge shape for ease of cooperation with the flange when releasing it from the abutment.

8. A battery powered lamp unit according to claim 6, wherein the flange is disposed at an angle transverse to the longitudinal axis of the container and unit so that as the unit is located within the container by a relative movement between the two, the abutment means and flange can pass one relatively to the other with a displacement of the flange by the abutments towards a more axial disposition until the abutment means leaves a free edge of the flange which then springs back to or towards its former attitude so that the edge can engage the abutment means and prevent its passing the flange if effort is made to pull the unit from the container.

9. A battery powered lamp unit according to claim 8, wherein a guide is defined between the battery compartment and the tubular container to guide the inserted key means from the opening in the container wall to the flange to displace it from the abutment means.

10. A battery powered lamp unit according to claim 9, wherein the key means is of flexible material, for example plastics, and is deformed after insertion through the aperture so as to move along a direction generally axially of the tubular container towards the locking means by force exerted transversely to the axis of the container on that part of the key means externally of the container.

* * * * *

UNITED STATES PATENT AND TRADEMARK OFFICE

CERTIFICATE OF CORRECTION

PATENT NO. : 4,573,109

DATED : February 25, 1986

INVENTOR(S) : Andrew J. Lack

It is certified that error appears in the above-identified patent and that said Letters Patent are hereby corrected as shown below:

In column 2, line 33, change the word "grove" to --groove--. In column 2, line 38, change "a a" to --as a--. In column 2, line 46, change "space" to --spare--. In column 2, line 52, change "rid" to --rib--.

In column 3, line 21, change the word "illutrating" to --illustrating--. In column 3, line 60, change "lowe" to --lower--.

In column 4, line 3, change the word "caue" to --cause--. In column 4, line 16, change the word "transvere" to --transverse--. In column 4, line 37, change "rid" to --rib--.

In column 6, line 16, change the word "edn" to --end--.

Signed and Sealed this

*Twenty-second* Day of *July 1986*

[SEAL]

*Attest:*

DONALD J. QUIGG

*Attesting Officer*

*Commissioner of Patents and Trademarks*